US005235758A

United States Patent [19]

Leonard

[11] Patent Number: 5,235,758

[45] Date of Patent: Aug. 17, 1993

[54] CABLE DRIER

[76] Inventor: W. B. Leonard, Rte. 1, Box 254, Waller, Tex. 77484

[21] Appl. No.: 944,535

[22] Filed: Sep. 14, 1992

[51] Int. Cl.[5] ..... F26B 13/00

[52] U.S. Cl. ..... 34/24; 34/153; 34/104; 34/110; 34/32

[58] Field of Search ..... 34/21, 23, 24, 73, 110, 34/104, 130, 153, 27, 32; 242/104, 77.1, 118.1

[56] References Cited

U.S. PATENT DOCUMENTS

| | | | |
|---|---|---|---|
| 1,663,897 | 3/1928 | Baumann, Jr. | 34/104 |
| 2,074,455 | 3/1937 | Carleton | 34/110 |
| 2,330,086 | 9/1943 | Soffner | 34/153 |
| 2,654,139 | 10/1953 | Lorig | 34/153 |
| 3,181,251 | 5/1965 | Ege et al. | 34/153 |
| 3,376,948 | 4/1968 | Morrow | 181/0.5 |
| 3,987,537 | 10/1976 | Warren | 29/592 |
| 4,296,481 | 10/1981 | Weiss | 367/20 |

*Primary Examiner*—Henry A. Bennet
*Assistant Examiner*—Denise L. Gromada
*Attorney, Agent, or Firm*—William A. Knox

[57] ABSTRACT

A device for force-drying an instrumented, multi-strand cable such as a seismic marine cable, consists of a reel having a slotted core around which the carcass of a cable is wrapped. A source of warmed, dehumidified air is blown into the interior of the core. The air circulates through the slots in the core, to circulate through the wraps of the cable, thereby to dry the cable carcass.

5 Claims, 2 Drawing Sheets

CABLE DRIER

BACKGROUND OF THE INVENTION

1. Field of the Invention

This invention relates to methods for preparing seismic streamer cables for repair. More specifically the invention is concerned with providing a convenient, simple means for drying the electronic equipment and the cable strands mounted on the carcass of a cable after that equipment has been washed down.

2. Discussion of the Prior Art

Marine seismic streamer cables are made up of a plurality of cable sections each on the order of 100 meters long. Each section includes a carcass that consists of stress members, bulkheads, seismic sensors, depth sensors, electrical and/or optical-fiber signal transmission lines, signal repeaters and signal processing modules. Protective shrouding may be wrapped around the signal transmission lines, particularly optical-fiber lines. The carcass is inserted in a jacket of polyurethane or the like, about three inches in diameter. The cable section is terminated at each end by a suitable electrical connector. The jacket is filled with odorless kerosene, sometimes referred to a cable oil, to make the section neutrally buoyant in the water. The connectors also form an oil seal at the section ends.

The construction of the carcass of a cable section is well known. See for example, U.S. Pat. No. 3,376,948 which issued Apr. 9, 1968 to D. E. Morrow, U.S. Pat. No. 4,296,481 issued Oct. 20, 1981 to B. F. L. Weiss and U.S. Pat. No. 3,987,537, issued Oct. 26, 1976 to N. Warren, all of which are incorporated herein by reference as teachings of marine seismic cable-section construction.

When a cable section becomes inoperative or damaged, a replacement section is introduced into the streamer. The damaged section is removed from the streamer cable and returned to a repair facility. There, the jacket is stripped from the section and the carcass is thoroughly scrubbed down to remove all traces of cable oil and salt water contamination to prevent corrosion of the electrical elements. After washing, the carcass must be completely dried before repairs are attempted. Passive air-drying is slow and not very practical for removing all of the moisture from the many cavities and recesses of the components.

There is a need for a convenient, simple means for drying a cable section prior to repair.

SUMMARY OF THE INVENTION

The drier of this invention includes a winding drum adapted to receive a plurality of wraps of a cable-section carcass. The winding drum includes a perforated core that has a flange secured to its opposite ends. A quick-disconnect fixture mounted in one of the flanges provides communication between the interior of the perforated core and an air source having high volumetric capacity. After a carcass has been wound around the core, a volume of low-pressure, dehumidified air is injected into the perforated core. The volume of dehumidified air passes through the perforations and around the wraps of the carcass, thereby to dry out the washed-down carcass.

BRIEF DESCRIPTION OF THE DRAWING

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
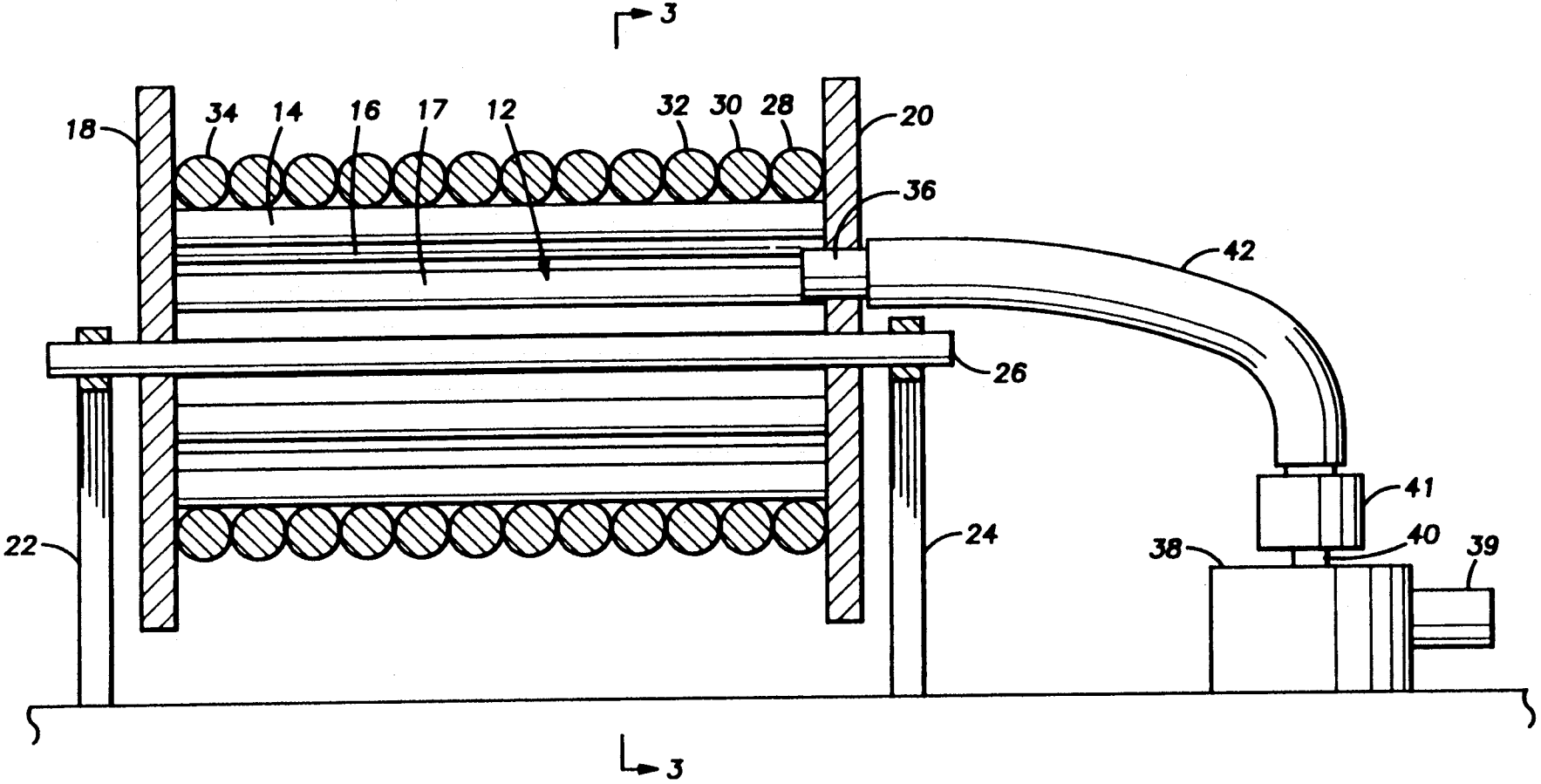
FIG. 1 shows a drying assembly, partially in cross section, for drying the carcass of a cable section.

With reference to FIG. 1, there is shown a drying assembly for forced drying of the carcass of an instrumented, multiple-strand cable such a marine seismic cable section. The assembly includes a winding reel 10 which consists of a perforated cylindrical core 12. Core 12 may be made of perforated metal sheeting, from expanded metal walk-plate or from a plurality of circularly-disposed lengths of tubing such as 14, 16 and 17, arranged in a slotted cylindrical configuration as shown in the drawing. The core is terminated at each end by oppositely-disposed flanges 18 and 20. The winding reel 10 may be rotatably supported from horses 22 and 24 or by any other convenient means, on shaft 26. Shaft 26 may be permanently mounted on reel 10 or it may be adapted to be manually inserted as needed through suitable holes in flanges 18 and 20 Reel 10 may be made of aluminum or other light-weight material. The reel may be of any convenient size that will allow the entire carcass of a cable section to be wound therearound in no more than two or three lays. A flange diameter of 55", a core length of 26" and a core diameter of 30" are typical dimensions.

In use, the carcass of a cable section is wound onto the reel 10 as a plurality of turns 28, 30, 32, 34. The reel is usually turned by hand during the winding process because the carcass is relatively light and a winding mechanism would needlessly complicate the assembly.

A fixture 36 is provided in one of the flanges such as 20, to furnish fluid communication with the interior portion of the core 12. The drier assembly includes a high-volume source 38 of low pressure air. Source 38 has an air inlet 39 and an air outlet 40 that is coupled to a dehumidifier 41. A flexible duct 42 of any desired type furnishes a connection between air source 38 and fixture 36. Duct 42 is coupled by any convenient means, such as by a quick coupler or the obvious type friction fit to fixture 36, but only after the carcass of a cable section has been wound onto reel 10. The air-supply components may be of any desired kind but preferably it would be of a type similar to the portable ventilation systems often used by public utilities for ventilating underground switch-gear vaults.

Figure 2:
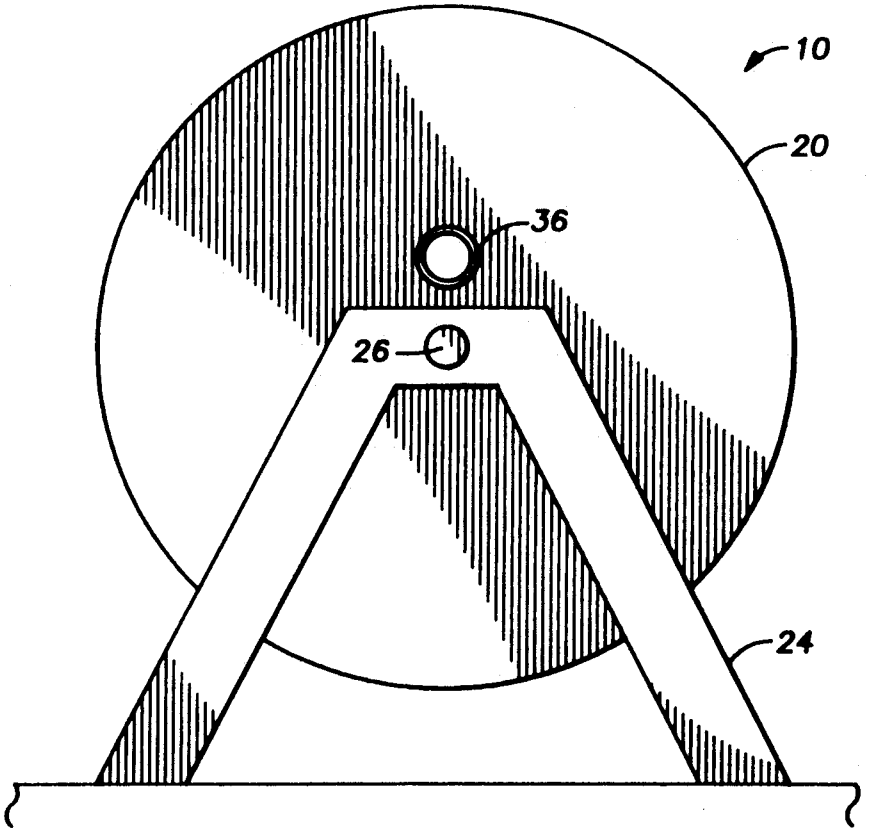
FIG. 2 is an end view of the winding reel.

FIG. 2 is an end view of the reel assembly showing the method of support.

Figure 3:
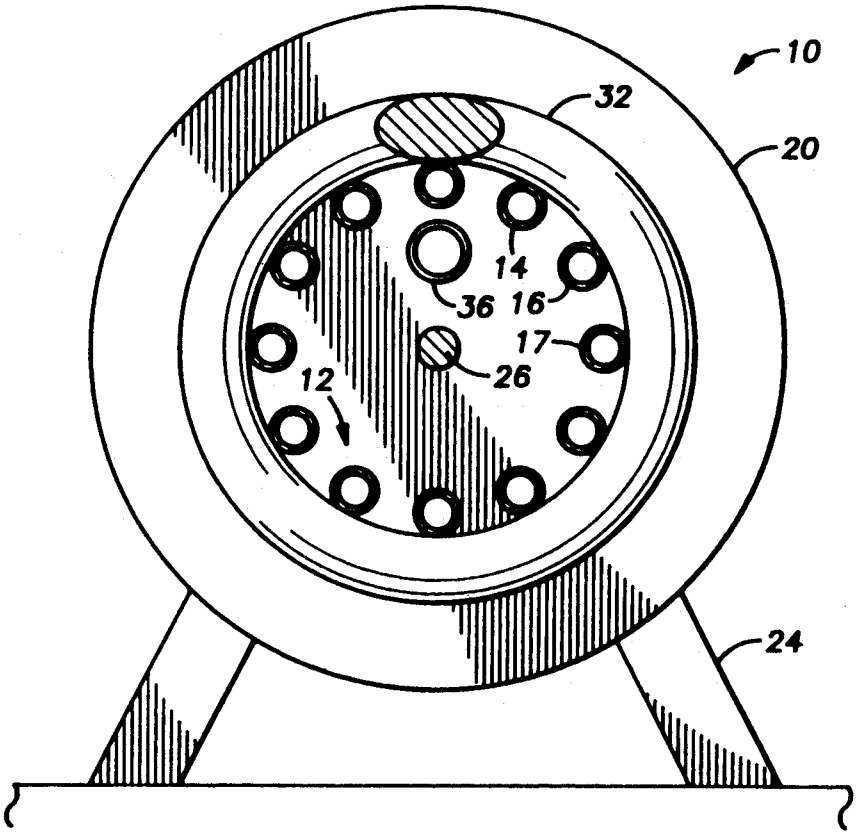
FIG. 3 is a cross section along line 3—3 of FIG. 1.

FIG. 3 is a cross section along lines 3—3 of FIG. 1. It is intended to show the configuration of the lengths of tubing such as 14, 16 and 17 that form the core that are distributed circumferentially as shown to form a slotted cylinder. One of the turns, 32, of a carcass is partially shown wrapped around the core 12.

In operation, a volume of warm dehumidified air is blown from air source 38, through flexible duct 42 and fixture 36 into the interior of core 12. The air flows through the slots between the lengths of tubing such as 14, 16, and 17 and around the wraps of the cable carcass that are wound around the core to force-dry the carcass. It is important that the air be properly dehumidified, particularly in moist climates, in order to accelerate the drying process. The volume of air may be moderately heated but not to a temperature above the safe maximum storage temperature of the electronic components.

This invention has been described with a certain specificity by way of example but not by way of limitation. Modifications may be made by those skilled in the art but which will fall within the scope and spirit of this invention which is limited only by the appended claims.

What is claimed is:

1. A cable drier, comprising:

a winding drum means for receiving a plurality of wraps of a carcass of a streamer cable, said winding drum means including a hollow perforated core and a pair of oppositely-disposed flanges secured to the ends of said core;

means for injecting a volume of air into said core and through said perforations, said volume of air providing means for force-drying the streamer cable carcass that is wrapped around said core; and means for de-humidifying said volume of injected air.

2. The cable drier as defined by claim 1, comprising: portable means for rotatably supporting said winding drum.

3. The cable drier as defined by claim 1, comprising:

an air inlet fixture mounted on a selected one of said flanges in fluid communication with said hollow perforated core; and quick-disconnect means for connecting a source of dehumidified low-pressure air to the interior of said hollow core of said winding drum after a carcass has been wound therearound.

4. A method for rapidly drying the carcass of a multistrand, instrumented cable, comprising:

providing a winding drum having a hollow core;

securing a flange to each end of said core;

perforating said core in a plurality of places;

wrapping the carcass of a cable a plurality of times around said core; and injecting a high volume of low-pressure dehumidified air heated to a desired temperature into the interior of said hollow core and through the perforated places of said core and around the wraps of said carcass thereby rapidly to force-dry said carcass.

5. A cable drier carcass assembly, comprising:

a drum, said drum including an elongated hollow slotted cylindrical core means for receiving the carcass of a cable section therearound;

a flange portion disposed at the opposite ends of said hollow core;

a fixture means in one of said flange portions for providing fluid communication with the interior of said hollow core;

a source of dehumidified air; and means for injecting a volume of dehumidified air from said source through said fixture into the interior of said hollow slotted core.

* * * * *